United States Patent [19]

Jones

[11] Patent Number: 4,836,536

[45] Date of Patent: Jun. 6, 1989

[54] APPARATUS FOR EXERCISING MUSCLES OF THE LOWER TRUNK OF THE HUMAN BODY

[76] Inventor: Arthur Jones, 1155 NE. 77th St., Ocala, Fla. 32670

[21] Appl. No.: 60,679

[22] Filed: Jun. 11, 1987

[51] Int. Cl.[4] ..... A63B 21/00

[52] U.S. Cl. ..... 272/134

[58] Field of Search ..... 73/379; 272/118, 134

[56] References Cited

U.S. PATENT DOCUMENTS

| | | | |
|---|---|---|---|
| 3,465,592 | 9/1969 | Perrine . | |
| 3,858,873 | 1/1975 | Jones | 272/58 |
| 3,866,914 | 2/1975 | Jackson | 273/55 |
| 3,971,555 | 7/1976 | Mahnke | 272/118 |
| 3,998,454 | 12/1986 | Jones . | |
| 4,257,592 | 3/1981 | Jones . | |
| 4,387,893 | 6/1983 | Baldwin . | |
| 4,456,245 | 6/1984 | Baldwin . | |
| 4,462,252 | 7/1984 | Smidt et al. | 73/379 |
| 4,478,411 | 10/1984 | Baldwin . | |
| 4,493,485 | 1/1985 | Jones . | |
| 4,500,089 | 2/1985 | Jones | 272/117 |
| 4,511,137 | 4/1985 | Jones . | |
| 4,538,805 | 9/1985 | Parviainen | 272/118 |
| 4,546,971 | 10/1985 | Raasoch | 272/118 |
| 4,589,656 | 5/1986 | Baldwin . | |
| 4,600,196 | 7/1986 | Jones | 272/134 |
| 4,610,449 | 9/1986 | Diercks, Jr. | 272/118 |
| 4,625,959 | 12/1986 | Schleffendorf | 272/118 |
| 4,648,594 | 3/1987 | Schleffendorf | 272/118 |
| 4,653,750 | 3/1987 | McIntyre | 272/134 |
| 4,666,152 | 5/1987 | Jones . | |
| 4,678,186 | 7/1987 | McIntyre | 272/134 |
| 4,712,793 | 12/1987 | Harwick et al. | 272/118 |
| 4,746,113 | 5/1988 | Kissel | 272/118 |

*Primary Examiner*—Stewart J. Levy
*Assistant Examiner*—Robert P. Bell
*Attorney, Agent, or Firm*—William E. Mouzavires

[57] ABSTRACT

Method and apparatus for exercising or testing the strength of muscles in the lower trunk of the human body. The patient or exerciser is seated with his pelvis and legs fixed against movement and with his head, arms and upper back fixed relative to a movement arm which extends above the seat and is mounted for pivotal movement relative to the seat about a horizontal axis. While the movement arm is in a predetermined position, the patient applies a force through the upper back to the movement arm to stress the muscles of the lower trunk, and the strength of these muscles is measured. To exercise these muscles, the movement arm is moved by a force exerted by the upper back against a bias of a resistance weight to lift the weight, and then the force is released to lower the weight and the process is repeated. A compound weight system is employed to allow precise weight adjustment to suit the strength of the exerciser. The movement arm including the weight of the exerciser is balanced about the pivot axis by means of counterweights including an adjustable counterweight.

14 Claims, 6 Drawing Sheets

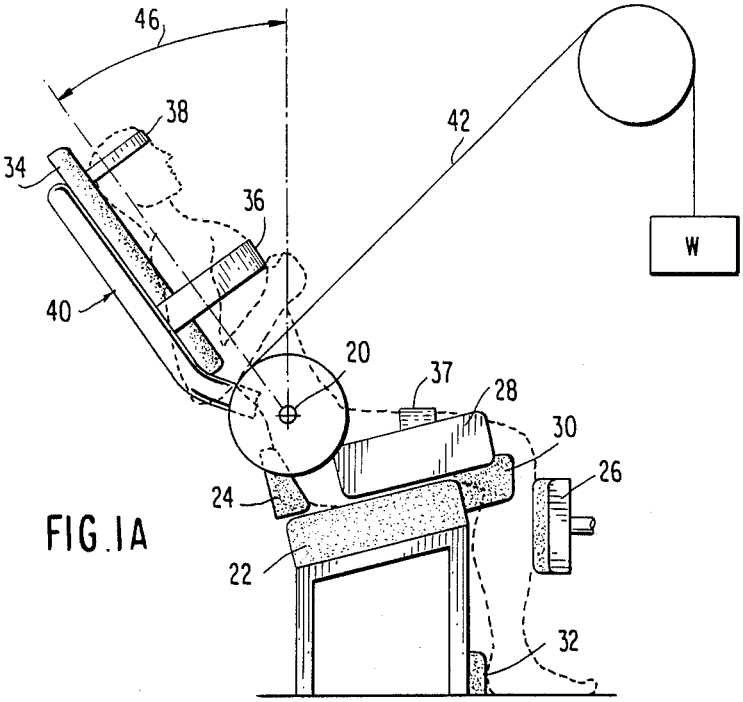
FIG. 1A
FIG. 3
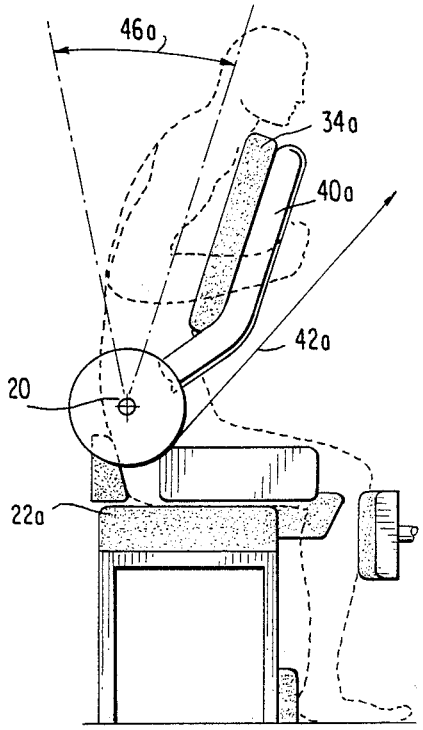
FIG. 12
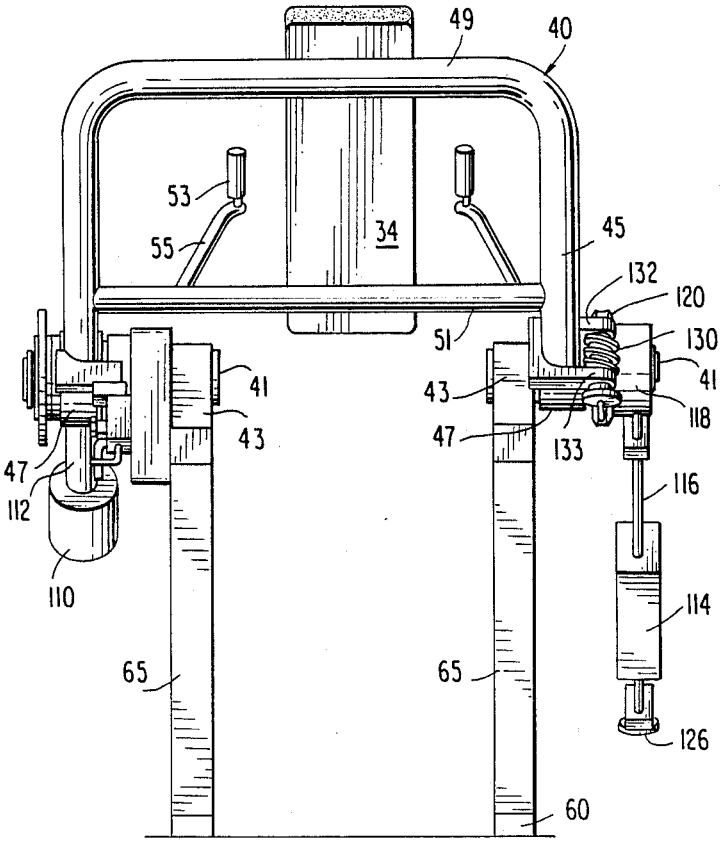
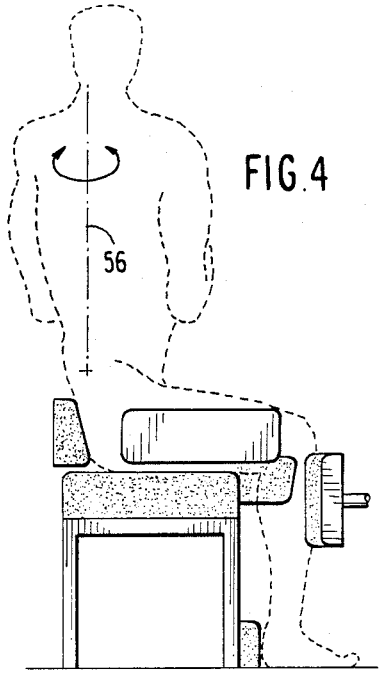
FIG. 4

FIG. 5
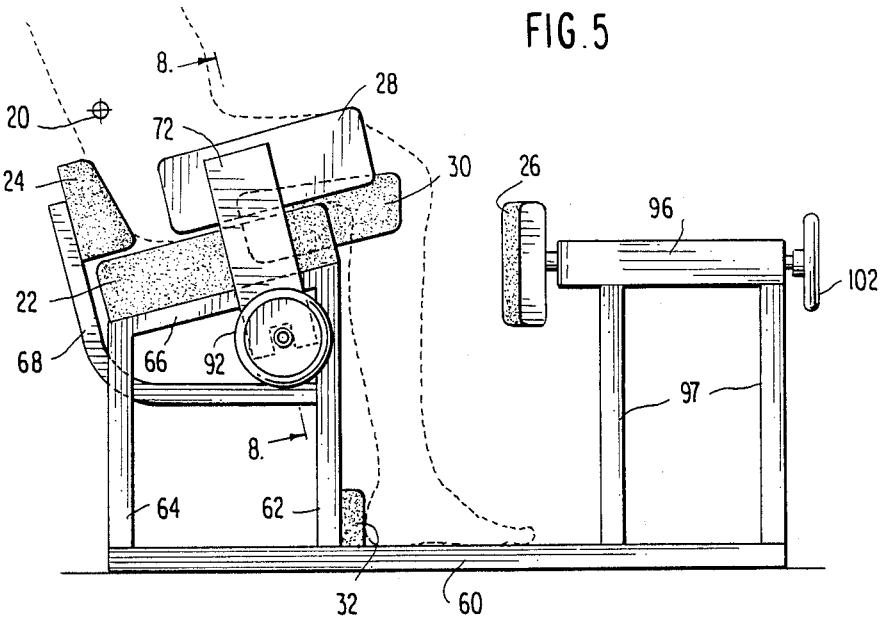
FIG. 6
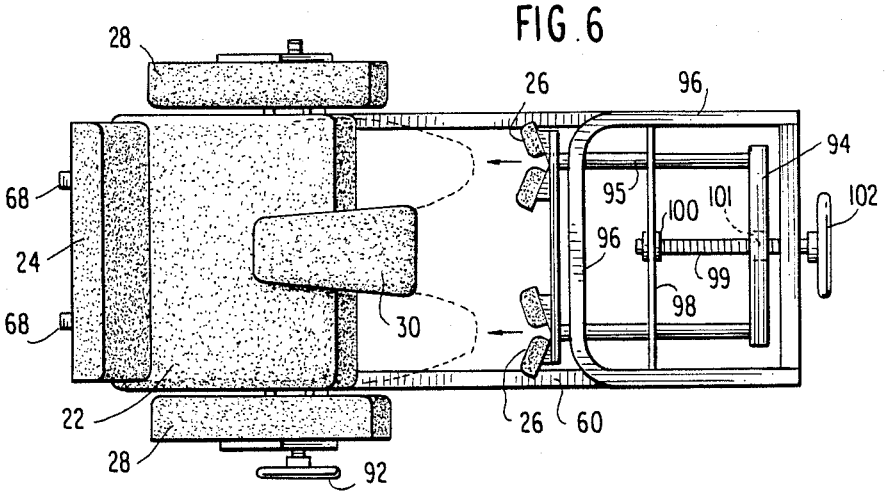
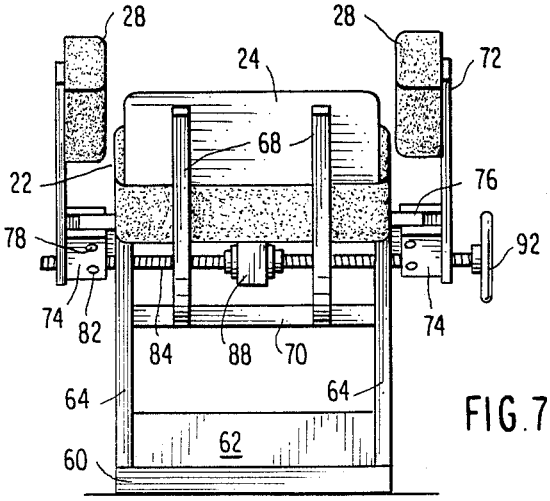
FIG. 7
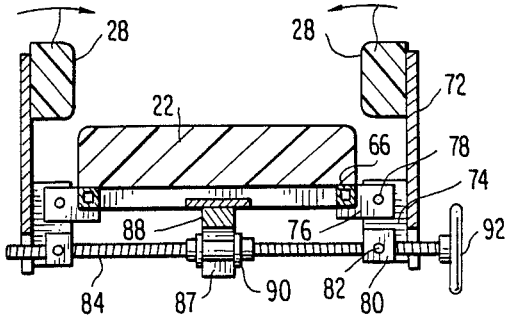
FIG. 8

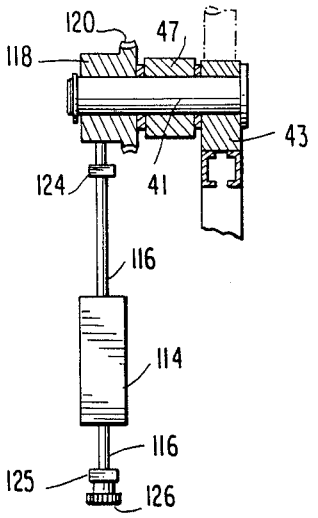
FIG. 13
FIG. 9
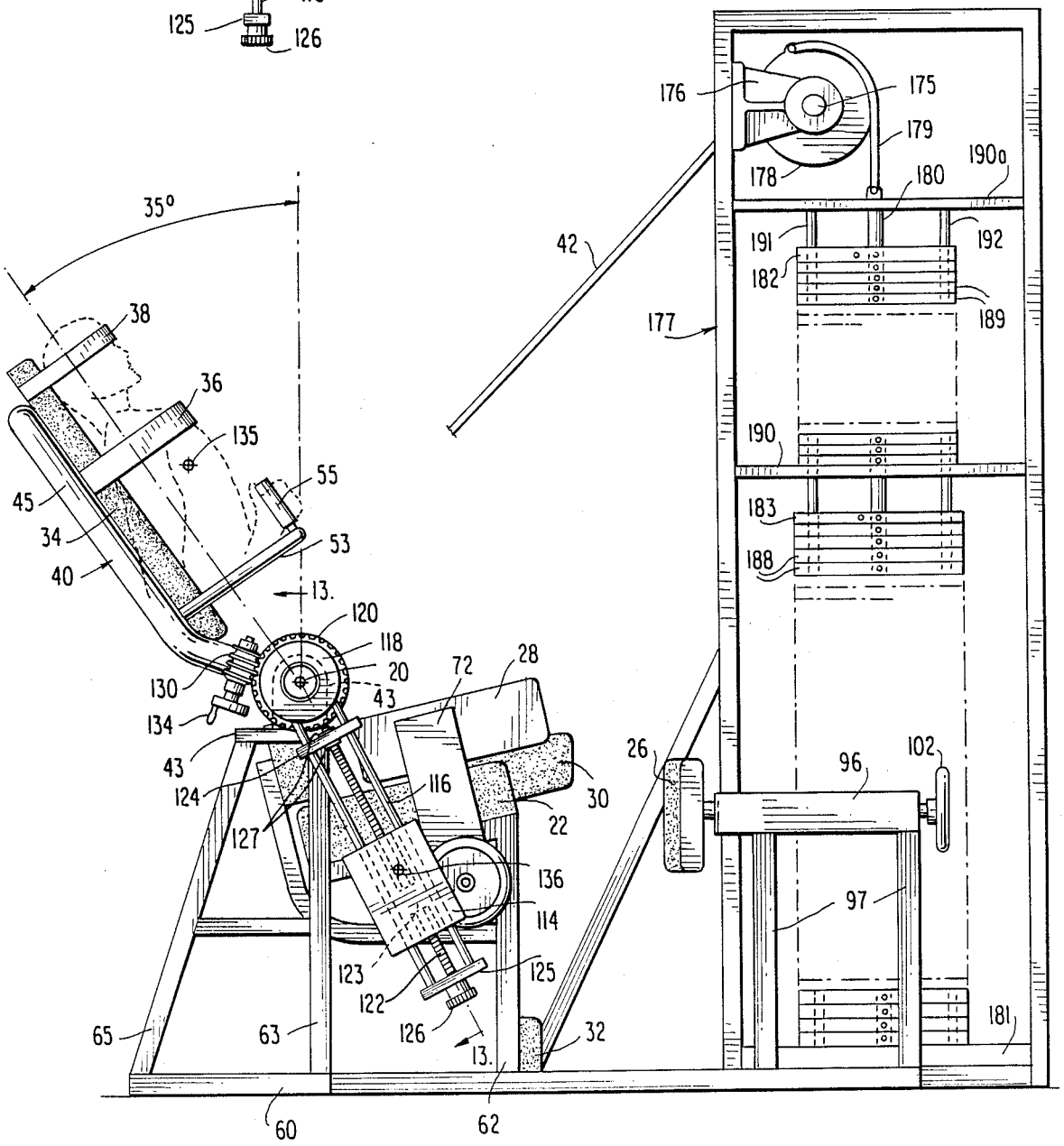

APPARATUS FOR EXERCISING MUSCLES OF THE LOWER TRUNK OF THE HUMAN BODY

BACKGROUND OF INVENTION

The present invention resides in novel methods and apparatus for stressing muscles of the human body in the region of the lower trunk including the spine and abdomen, for purposes of testing the strength of, or exercising, these muscles. More specifically, the muscles concerned herein are those which move the spine rearward, i.e., the lumbar or spinal erector muscles; those which move the spine forwardly, i.e., the abdominal muscles; and those muscles which rotate or twist the spine about the spinal axis, i.e., the rotary torso muscles. As used herein, the term "lower trunk" includes the region of the human body above the pelvis and which includes the aforementioned muscles and which, of course, excludes the head, neck and limbs of the body. The lumbar, abdominal and rotary torso muscles are connected to the lower spine which is founded on the pelvis. The lumbar muscles are connected to and support the lower spine at the five lowermost vertabrae.

It is now fairly well-established that most injuries to the lower back in the region of the lumbar are due to failure of the lumbar muscles rather than the spine itself. Thus, it is not unusual in back injury cases, to find the spine in order but with pain or malfunction still persisting in the lower back. In such cases, it is obvious that treatment to the spine itself will not alleviate or cure the problem.

It is my belief that attempts by others thus far to test and/or exercise the lumbar muscles have failed due to the inability to immobilize the gluteus maximus and hamstring muscles during such tests or exercise. The latter muscles are connected to the femurs of the thighs which femurs are mounted in sockets in the pelvis. Unless the gluteus and hamstring muscles are immobilized during tests of the lumbar muscles, the former muscles will become involved to render the tests as inaccurate and misleading. Similarly, any intended exercise of the lumbar muscles while the gluteus and hamstrings are free to assist the lumbar muscles, will be inefficient if not ineffective.

In addition to being inaccurate in the manner described above, prior methods and apparatus have been further inaccurate because they fail to take into account the position of the patient during a test. In other words, they fail to correlate the strength of the muscles tested with the position of the patient during the test. It is proven fact that the strength of muscles will vary with the position of the patient or the muscles during the test. Indeed, it has been proven that slight variations in position can produce substantial differences in muscle strength. It therefore follows that to achieve accurate test results and to properly compare them with past or future results, the muscles must be tested while the patient is in a predetermined or known position.

In addition to being ineffective or inefficient, some "dynamic" methods of the prior art for exercising the lower back are believed to be unsatisfactory from the standpoint of safety. This is due to impact loads imparted to the body during such exercise, for example, when relatively high kinetic energy is generated in a mass being repetitively lifted and released by the exerciser.

OBJECTS OF THE PRESENT INVENTION

An object of the present invention is to provide novel methods and apparatus for testing or exercising muscles of the lower trunk and which overcome the above noted problems heretofor attending methods and apparatus of the prior art. Included herein are such methods and apparatus which will accurately test the strength of the muscles in question and which may also be used to exercise these muscles with safety and efficiency.

A further object of the present invention is to provide novel methods and apparatus for testing or exercising the lumbar muscles, abdominal muscles or the muscles which control torsional movement of the lower trunk about the axis of the spine.

Another object of the present invention is to provide novel methods and apparatus for testing the strength of the lower trunk in different predetermined positions of the human body in order to achieve accurate results.

A further object of the present invention is to provide novel methods and apparatus for isolating the muscles of the lower trunk for testing or exercise.

A still further object of the present invention is to provide novel methods and apparatus for exercising the muscles of the lower trunk of the human body without imposing any harmful impact loads on the body.

Another object of the present invention is to provide an improved weight system for exercising the muscles of the body and which may be adjusted in small or large increments with precision to suit the strength of the person being exercised.

Another object of the present invention is to provide such methods and apparatus which will achieve the above objects and yet may be easily and safely applied without any special skills or training.

SUMMARY OF INVENTION

In brief summary, the method of the present invention isolates the muscles of the lower trunk of the human body, and tests the strength of or exercises these muscles while isolated from other muscles which would otherwise become involved to adversely affect the results. Additionally, the method tests the isolated muscles while in a predetermined position and preferably, repeats the tests at several predetermined different positions of the human body.

The muscles in question are isolated by fixing the pelvis against movement and in one preferred mode of the invention, this is accomplished by preventing movement of the femurs. Anchoring the pelvis against movement, prevents movement of the gluteus and hamstring muscles to thus isolate the muscles in question above the pelvis. A force is then applied by the exerciser through the upper body against a resistance object to exercise or test the muscles of the lower trunk. During the latter, the upper body is held in a fixed position relative to the resistance object while exerting a force against the resistance object.

One preferred apparatus for carrying out the above method includes a seat for receiving a person in sitting position with the pelvis anchored between a stop at the back of the seat and front leg restraints which prevent longitudinal movement of the femurs to thus anchor the pelvis against movement which, in turn, prevents movement of the gluteus and hamstring muscles. Above the seat extends a movement arm mounted for movement relative to the seat. The upper back is fixed to the movement arm for exerting a force against the movement arm to stress the muscles of the lower trunk. In the test mode of the apparatus, a gauge is used to measure the strength of the isolated muscles as the upper back applies a force against the movement arm. Preferably, the test is repeated at several different predetermined angular positions of the movement arm relative to the seat. When the apparatus is used to exercise the isolated muscles, the movement arm is repetitively moved by the upper body against the bias of a resistance weight to lift and lower the weight as force is applied to and released from the movement arm. Other aspects and features of the invention are disclosed in the detailed description appearing below.

DRAWINGS

Other objects and advantages will become apparent from the following detailed description taken in conjunction with the attached drawings in which:

FIG. 1A is a schematic side view illustrating a method and apparatus embodying the present invention for exercising the lumbar muscles of a human shown in dotted lines;

FIGS. 3 and 4 are views generally similar to FIG. 1 but showing methods and apparatus for exercising the abdominal and rotary torso muscles respectively;

FIG. 5 is a fragmental, side elevational view of a lower part of apparatus embodying the invention for exercising or testing the lumbar muscles of a human partially shown in dotted lines;

FIG. 6 is a top plan view of the apparatus shown in FIG. 5;

FIG. 7 is a rear, elevational view of the apparatus shown in FIG. 5 but with the human and other parts of the apparatus omitted for clarity;

FIG. 8 is a fragmental, cross-sectional view taken generally along lines 8—8 of FIG. 5 and with the human omitted;

FIG. 9 is a side, elevational view of the entire apparatus shown with a human secured therein;

FIG. 12 is a rear, elevational view of a movement arm and its support frame included in the apparatus;

FIG. 13 is a fragmental, cros sectional view taken generally along lines 13—13 of FIG. 9;

DETAILED DESCRIPTION

Figure 2:
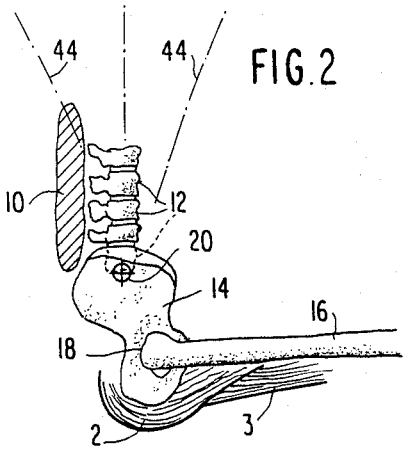
FIG. 2 is a fragmental, schematic side view of the pelvis and lumbar regions and illustrating in dotted lines, the flexing of the lower spine.

Referring to the drawings there is shown, for illustrative purposes only, methods and apparatus for testing or exercising muscles of the lower human trunk as achieved with preferred embodiments of the present invention.

The Method Applied to the Lumbar Muscles—FIGS. 1A and 2

Referring initially to FIGS. 1A and 2, a method of exercising the lumbar or spinal erector muscles 10 is shown, it being understood that these muscles 10 are located in the lower back adjacent the five lowermost vertabrae 12 which are supported on the pelvis 14 as diagrammatically illustrated in FIG. 2. In accordance with the invention, the pelvis is anchored against movement and, in the preferred embodiment, this is effected by preventing movement of the femurs 16 which are the bones in the thighs received in sockets 18 of the pelvis as illustrated in FIG. 2.

Referring to FIG. 1A, the femurs are restrained against movement to anchor the pelvis in the preferred embodiment, by placing the patient or exerciser in a sitting position on a seat 22 and against a truncated or short backrest termed herein a "pelvic-rest" or "pelvic-stop" 24 which terminates at its upper end below the lumbar region. To restrain the femurs against longitudinal movement, a pair of leg restrainers 26 are placed against the legs just below the knee caps. Lateral movement of the femurs and pelvis is prevented by side or hip restrainers 28 which engage the opposite sides of the thighs and hold the thighs against a stop 30 fixed to and projectingg forwardly from the front of the seat 22 between the thighs. Preferably, a thigh strap 37 is secured over the thighs to prevent upward movement of the femurs and thighs, and foot stops 32 are positioned behind the heels to locate the feet in proper fixed position.

Referring to FIG. 2, the effect of anchoring the pelvis 14 against movement in the manner described above, is to immobilize the gluteus maximus muscles 2 and the hamstring muscles 3 which are connected between the pelvis 14 and femurs 16 and therefore cannot move unless the pelvis is capable of movement. With the gluteus and hamstring muscles 2 and 3 immobilized, the lumbar muscles 10 can be exercised without involvement of the gluteus and hamstring muscles.

Referring to FIG. 1A, the lumbar muscles are stressed to exercise them by applying a force through the upper back against a resistance object illustrated as an upper backrest 34 whose lower end terminates above the lumbar region. The upper body and preferably including the head, is fixed to the upper backrest 34 such as by straps 36 and 38 to prevent relative movement of the upper body and the upper backrest 34. In addition, it is preferred that the arms be fixed in position against movement relative to the upper backrest 34, and this may be acomplished by handle bars 53 to be described below in a more detailed description of the apparatus. The upper backrest 34 is fixed to a movement arm 40 which extends generally vertically and is mounted for pivotal movement about a fixed horizontal axis 20 which coincides with the effective axis of rotation of the vertabrae 12 (see FIG. 2). The vertabrae will flex to and fro during the exercise in a range illustrated by the lines 44 in FIG. 2. The movement arm 40 is connected to a resistance weight W by a cable or chain 42 so that rearward pivotal movement of the movement arm will lift the weight W and forward movement will lower the weight W.

Figure 11:
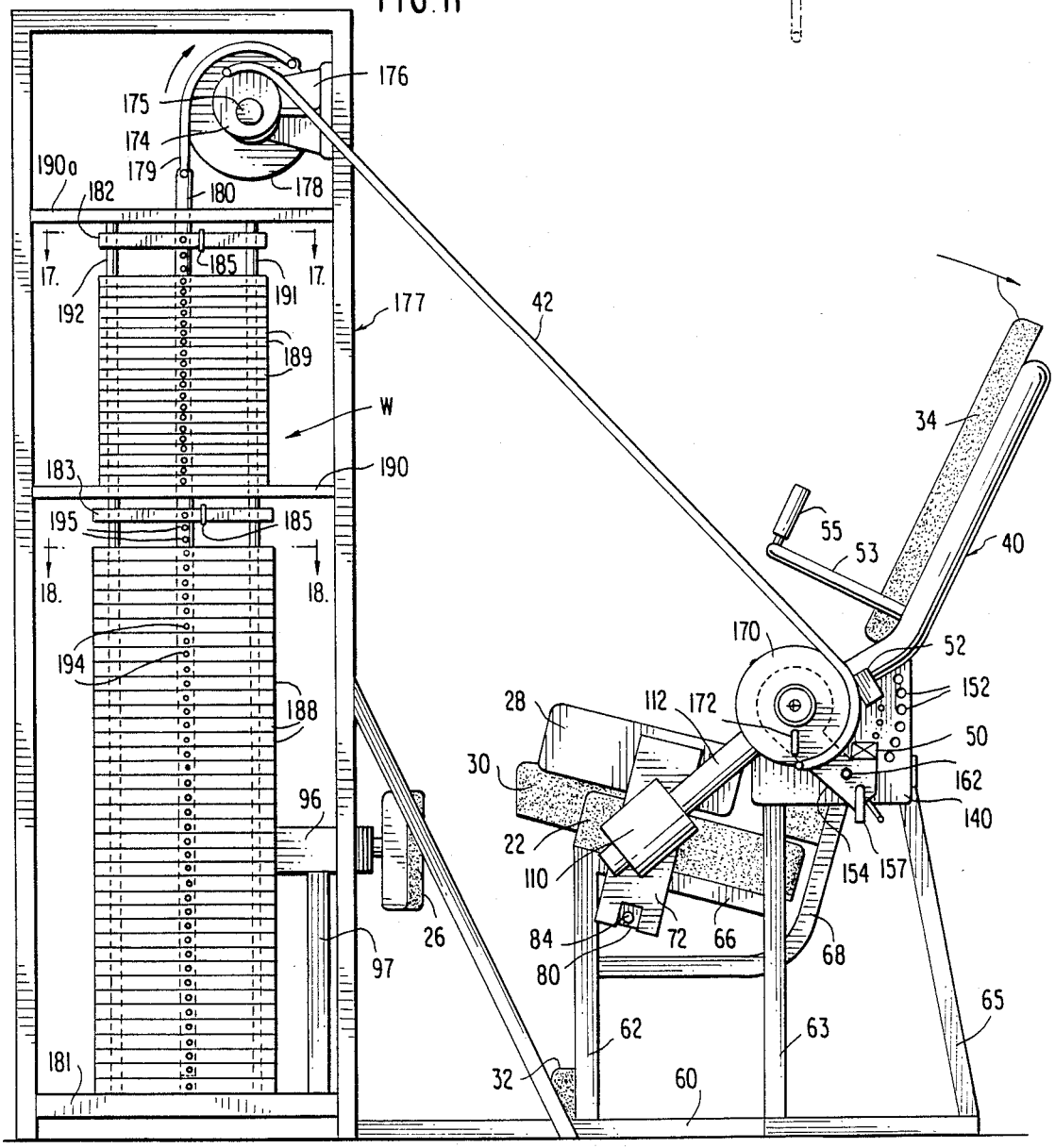
FIG. 11 is a side, elevational view of the apparatus in an exercise mode as seen from the side opposite the side shown in FIG. 9 and with the human omitted.

Once the patient or exerciser is in the proper position described above with his pelvis, and gluteus and hamstring muscles immobilized and his upper body fixed to the resistance object 34, he may begin to exercise his lumbar muscles without involvement of the gluteus and hamstring muscles. The exercise is achieved by applying a force through the upper body rearwardly against the resistance object or upper backrest 34 to pivot the movement arm 40 about axis 20 against the resistance of the weight W. The exerciser will then move forwardly aided by the wight W and then rearwardly against the bias of the weight and the process is repeated within a range of movement illustrated by the arc 46 in FIG. 1A. In this manner, the exercise is efficiently concentrated on the lumbar muscles in accordance with the invention. Depending on the strength of the exerciser, the magnitude of the weight W may be adjusted to permit the exerciser to perform to the limit of his strength. Described below in conjunction with FIG. 11, is a novel compound weight system which allows the magnitude of the weight W to be adjusted in increments of one pound within a range of, for example 20 to 800 pounds.

Figure 1B:
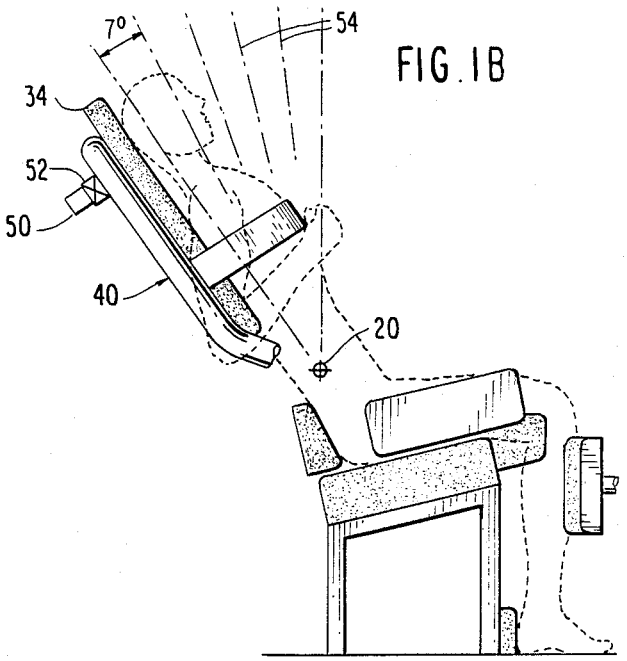
FIG. 1B is a view generally similar to FIG. 1A but showing a method and apparatus embodying the invention for testing the lumbar muscles in several different predetermined positions shown in dotted lines.

In addition to exercising the lumbar muscles, a method is provided for testing the strength of the lumbar muscles. This method is illustrated in FIG. 1B and is performed with the patient held in the same position as described above. However, the weight W is disconnected from the movement arm 40 and instead, the movement arm is brought to rest on a stop 50 engaged by a stop 52 fixed to the movement arm. Stop 50 is a gauge such as a strain gauge. The patient then applies a rearward force through the upper body against the upper backrest 34, and the strength of the lumbar muscles is measured through the strain gauge 50. The test is repeated at several different angular positions of the movement arm spaced, for example, at seven degree (7) intervals as shown in the lines 54 in FIG. 1B, and the strength of the lumbar muscles is measured at each position.

The Method Applied to the Abdominal Muscles—FIG. 3

In addition to the lumbar muscles, the pesent invention may also be applied to exercise or test abdominal muscles. This is illustrated in FIG. 3 where the patient's pelvis is anchored against movement in the same manner described above in connection with FIG. 1 except that in the mode of FIG. 3, it is preferred that the seat 22*a* extend horizontally whereas, in the FIG. 1 mode, it is preferred that the seat 22 extend rearwardly and downwardly at a slight angle to the horizontal. In the present mode, the movement arm 40*a* is positioned in front of the exerciser's upper body which is secured to a resistance object 34*a* fixed to the movement arm 40*a* to extend between the chest and the abdomen as shown in FIG. 3. The movement arm 40*a* is connected to a resistance weight (not shown) by a cable or chain 42*a* such that forward pivotal movement of the movement arm 40*a* will lift the weight and rearward movement will lower the weight. Once the pelvis is secured, the exerciser applies a force through his upper body at the chest to the resistance object 34*a* to pivot the movement arm and lift the resistance weight while stressing his abdominal muscles in the process, and then the exerciser moves his upper body rearwardly to lower the weight and successively repeats the process until his abdominal muscles are sufficiently exercised. The range of movement of the upper body during the exercise is between the lines 46*a* shown in FIG. 3. The apparatus illustrated in FIG. 3 may be converted to test the strength of the abdominal muscles using the same principles as described above in connection with the method and apratus of FIG. 1A. However, in the present instance, the stop and strain gauge (not shown in FIG. 3) are located forwardly of the movement arm 40*a* and the patient exerts a forwardly directed force on the resistance object 34*a* to activate the strain gauge.

The Method Applied to the Rotary Torso Muscles—FIG. 4

By anchoring the pelvis against movement in the same manner described above, the rotary torso muscles may also be exercised or tested as illustrated in FIG. 4. However, in this instance, the upper back is secured to a movement arm (not shown in FIG. 4) which pivots or rotates about a vertical axis 56 as a torsional moment is applied to the movement arm through the upper back of the exerciser. The torsional moment is applied and released repetitively relative to a resistance weight (not shown) to stress the rotary torso muscles without involvement of the gluteus or hamstring muscles. The strength of the rotary torso muscles may also be tested using the same principles and analogous conversion of the apparatus as described above.

Detailed Description of Preferred Apparatus—FIGS. 5 Through 18

Apparatus constituting a preferred embodiment of the invention for carrying out the above-described methods of exercising or testing the lumbar muscles as illustrated in FIGS. 1A, 1B and 2 is shown for illustrative purposes only in FIGS. 5 through 18.

Seat 22 and Associated Stops and Restrainers

Figure 10:
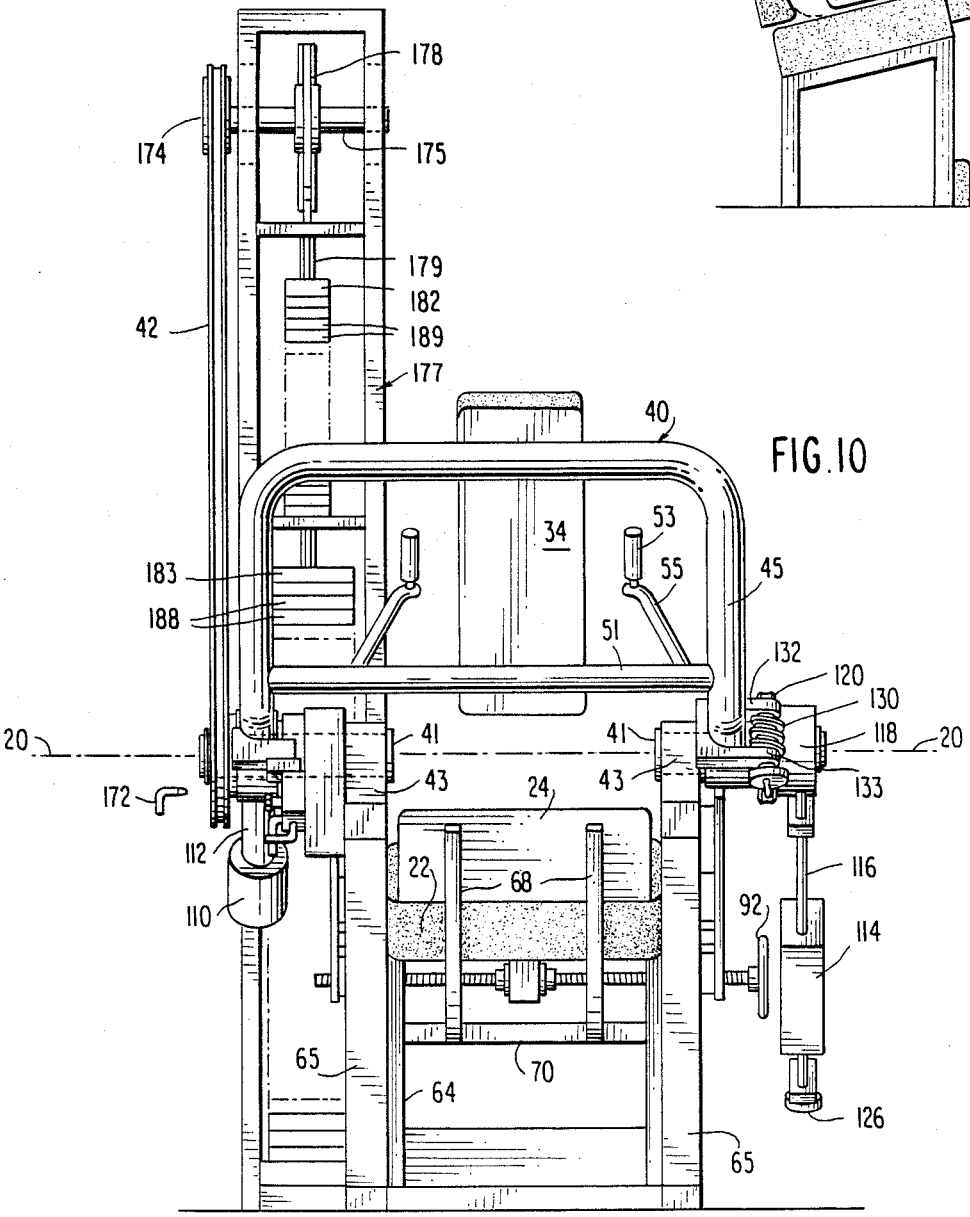
FIG. 10 is a rear, elevational view of the apparatus of FIG. 9 but with the human omitted.

Referring initially to FIGS. 5 and 6, the apparatus includes a generally rectangular base frame 60 adapted to rest on the floor, and a plurality of vertical legs including front and rear legs 62 and 64 fixed to and upstanding from the base frame and interconnected by frame members 66 which, in the preferred form, extend rearwardly and downwardly at a slight angle of about fifteen degrees (15) to provide a base for a seat 22 which may be formed with any suitable pad and upholstery construction. Referring to FIGS. 5, 6 and 10, a pair of frame members 68 are connected to the legs 62 and 66 by cross members 70 to provide support for a pelvic stop 24 which extends across and projects above the rear of the seat 22 to provide a stop for preventing rearward movement of the pelvis and buttocks. Pelvic stop 24 is formed with any suitable pad and upholstery construction. Projecting forwardly from the front of the seat 22 at the center thereof as best shown in FIGS. 5 and 6, is a stop to be straddled by the thighs for engaging the inner sides of the thighs to position them against inward movement. The thigh stop 30 may have any suitable pad and upholstery construction fixed to and projecting above the seat with its opposite sides converging slightly to the rear to fit the contour of the thighs which are illustrated at 72 in FIG. 6.

In order to hold the thighs against the stop 30 in fixed position against movement, a pair of hip restrainers 28 are mounted on opposite sides of and the seat 22 to extend longitudinally along the hips and thighs. Hip restrainers 28 are formed of any suitable pad construction and are mounted on arms shown as rectangular plates 72 to be adjusted laterally inwardly to apply pressure on the thighs or outwardly to release the thighs. In specific embodiment shown and with reference to FIG. 8, arms 72 are fixed to brackets 74 which are pivotally connected to the seat frame 66 by a link 76 which is fixed to the seat frame 66 and pivotally connected at 78 to bracket 74. The lower ends of bracket 74 have pivotally mounted thereto at 82, nuts 80 which receive a threaded rod 84 extending from one side to the other side below the seat 22. The central portion of the rod 84 is received through a slot 87 formed in an abutment fixed to and depending from the bottom of the seat 22. Engageable on the opposite sides of the abutment 88 to prevent longitudinal movement of the rod 84 are a pair of flanged sleeves mounted on the rod 84. A hand wheel 92 is fixed to one end of the rod 84 which may be turned to advance or retract nuts 80 along the rod 84 during which brackets 74 together with arms 72 and hip restrainers 28 will pivot relative to the links 78 and nuts 80 to move the hip restrainers 28 inwardly or outwardly depending on the driection of rotation of hand wheel 92. Vertical movement of the rod 84 during adjustment of the hip restrainers is accommodated by slot 87 provided in abutment 88 for this purpose.

In order to prevent movement of the femurs when the patient is seated in the apparatus and against the pelvic stop 24 as shown in FIG. 5, a pair of leg restrainers 26 are mounted forwardly of the seat 22 for horizontal movement between an inoperative position shown in FIG. 5 where they are spaced from the patient's legs and an operative position shown in FIG. 1A where they engage the legs just below the knee caps to thus prevent longitudinal movement of the femurs which, in turn, functions to anchor the pelvis against movement. Leg restrainers 26 may have any suitable padded construction with a generally V-shaped as shown to fit the contour of the legs as shown in FIG. 6. In the specific embodiment shown in FIG. 6, leg restrainers 26 are mounted for movement as described above by means of a yoke including crosspieces 93 and 94 interconnected by side pieces 95 to form a generally rectangular frame. Leg restrainers are fixed to crosspiece 96 while the side pieces 95 are received through a stationary generally rectangular frame 96 supported from the base 60 by legs 97 shown in FIG. 5. Extending between and fixed to opposite sides of stationary frame 96 is a support member 98 which slidably receives the side pieces 95 of the yoke. Additionally, support member 98 also functions to mount one end of an actuating screw 99 in the form of a rod which is held against longitudinal movement by washers 100 mounted on the rod 99 on opposite sides of support member 98 which they engage. The opposite end portion of rod 99 is mounted through the end member of stationary frame 96 and is threaded through a nut 101 fixed in the crosspiece 94 of the yoke. A handwheel 102 is fixed to the end of rod 99 so that rotation of the rod will cause the yoke to move along the rod 99 to extend or retract the leg restrainers 26 depending on the direction of rotation of the rod 99.

In order to ensure that the legs are properly positioned and will not move, it is preferred that foot stops 32 be positioned to be engaged by the heels of the exerciser as shown in FIG. 5. In the shown embodiment, foot stops 32 are provided by a single pad fixed at the base against the front legs 62 of the seat as shown in FIGS. 5 and 7. Although the restraint of the thighs between the leg restrainers 26 and pelvic stop 24 and between the hip restrainers 28 and the stop 30 will generally be sufficient to prevent movement of the femurs to anchor the pelvis, it is also preferred that a thigh strap 37 be secured over the thighs to make sure that upward movement of the thighs is prevented.

Movement Arm 40

Figure 15:
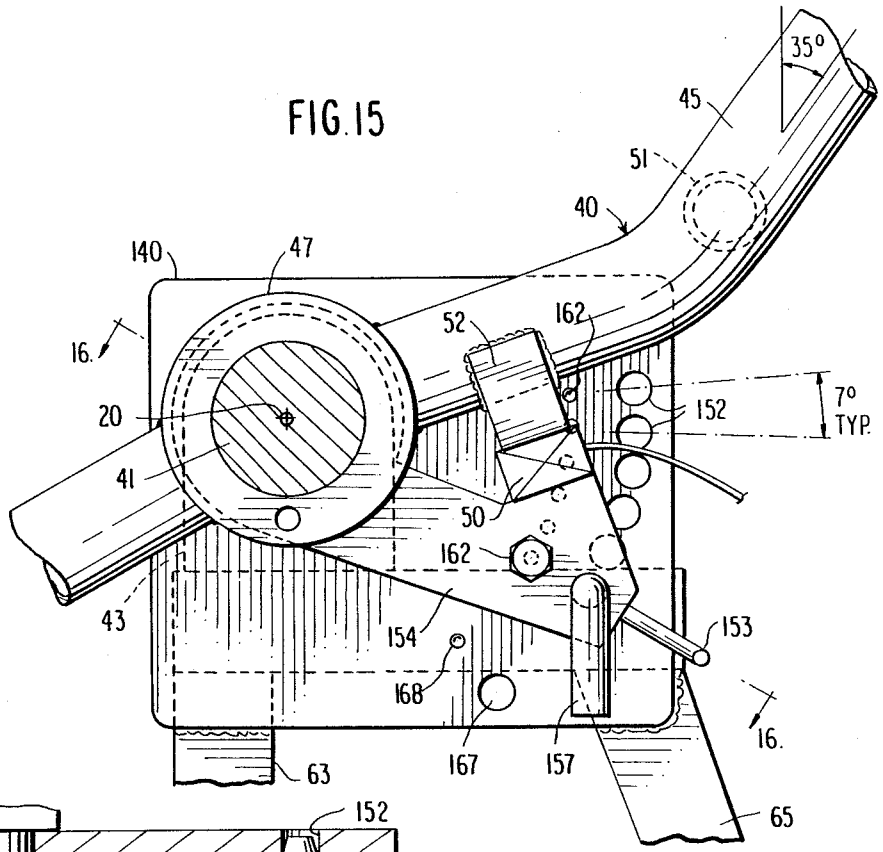
FIG. 15 is a cross-sectional view taken generally along lines 15—15 of FIG. 14.

In order to stress the lumbar muscles for purposes of testing or exercising them, a movement arm generally designated 40 is mounted for pivotal movement about a horizontal axis shown at 20 in FIGS. 1A and 9. As described above, the pivot axis 20 of the movement arm 40 coincides with the effective axis of rotation of the lumbar vertabrae 12 as shown in FIG. 2. In the specific embodiment shown, the mounting of the movement arm 40 is accomplished by stub shafts 41 mounted in blocks 43 fixed to stationary support legs 63 and 65 upstanding from the base 60 on opposite sides of the seat 22 as shown in FIGS. 9, 12 and 15. Referring to FIGS. 9 and 12, movement arm 40 in the preferred embodiment is made from tubular steel and includes opposite vertical portions 45 which extend upwardly from hubs 47 journalled on stub shafts 41 to an upper crosspiece 49 which is at a level to extend behind the region of the head of the exerciser. As shown in FIG. 12, the vertical side portions 45 of the movement arm 40 are also interconnected at their lower end portions by a crosspiece 51. Rigidly fixed to the crosspieces 49 and 51 (see FIG. 12) of the movement arm 40 is a resistance object 34 which is adapted to receive the upper back of the exerciser as shown in FIG. 9. Resistance object 34 may have any suitable padded construction centered over the rear of the seat 28 and extending from a level above the lumbar region to a level behind the head of the exerciser.

In order to secure the upper body to the movement arm 40, a pair of straps 36 and 38 are fixed to the resistance object 34 at levels to enable them to be secured about the chest and forehead of the exerciser as shown in FIG. 9. In addition, it is preferred that the arms of the exerciser be held in fixed position relative to the movement arm 40. In the preferred embodiment this is accomplished by a pair of handle bars 53 rigidly fixed to the movement arm 40 and projecting forwardly where they terminate in hand grips 55 adapted to be grasped by the exerciser as shown in FIG. 9. During use of the apparatus as will be described in more detail below, the exerciser exerts a force through his upper body against the resistance object 34 to pivot the movement arm about the stub shafts 41.

Counterweights 110 and 114

In order to neutralize the effect of the weight of the movement arm 40 which would otherwise produce a moment about the pivot axis 20, a counterweight 110 is fixed to the movement arm to extend below the pivot axis 20 as shown in FIGS. 11 and 12. In the specific embodiment shown, counterweight 110 is fixed to an extension 112 of the movement arm fixed to and extending below one of the hubs 47 as shown in FIGS. 11 and 12. The magnitude of counterweight 110 and its distance from the pivot axis 20 are selected to impose a moment that balances or equally opposes the opposite moment produced by the weight of the movement arm 40 and resistance object 34 including the handle bars 55, etc., but excludes the weight of the exerciser whose weight and mass will, of course, vary from person to person.

In order to counterbalance the weight and mass of a particular exerciser, an adjustable counterweight assembly is provided on the movement arm on the side opposite the fixed counterweight 110 just described above. Referring to FIGS. 9, 10 and 13, in the specific embodiment shown, the adjustable counterweight assembly includes a weight block 114 mounted for slidable movement on long rods 116 whose upper ends are fixed to the hub 118 of a worm gear 120, the latter being mounted for rotation on stub shaft 41. Weight 114 is adjustable along rods 116 by means of a non-rising screw 122 extending through a passage in weight 114 where it is threaded through a nut 123 fixed within the passage of weight 114. The opposite end portions of actuating screw 122 are received for rotation in yokes 124 and 125 fixed to and between rods 116 at opposite end portions thereof. Actuating screw 122 although rotatably mounted in yoke 124, is prevented from moving longitudinally by washers 127 mounted on screw 122 on opposite sides of yoke 124. To rotate screw 122 for adjusting weight 123 along rods 116, a knob 126 is fixed to the lower end of the screw.

In addition to the aforedescribed means for adjusting weight 114 towards or away from the pivot axis 20 of the movement arm, means is also provided for adjusting the angular position of weight 114 relative to axis 20. In the specific embodiment shown, this includes the worm gear 120 mounted on stub shaft 41 as described above and shown in FIGS. 9 and 13. In mesh with worm gear 120 as shown in FIG. 9 is a worm 130 mounted on the movement arm 40 for rotation by flanges 132 and 133 of a bracket fixed to movement arm as shown in FIGS. 10 and 12. Rotation of worm 130 by a handle 134 will rotate worm gear 120 about stub shaft 41 to adjust the angular position of weight 114 relative to axis 20 of the movement arm.

In order to counterbalance the weight of the particular person using the apparatus, the movement arm 40 may first be placed in an extreme angular position shown, for example, in FIG. 9. This may be facilitated by a fixed stop such as gauge 50 described above in connection with FIG. 1B and to be described in greater detail below in conjunction with FIGS. 14 and 15. Weight 114 is the adjusted through the worm 130 and/or screw 114 until the movement arm 40 with the person installed is balanced for the extreme position. This balance will be indicated when the movement arm just begins to move off the stop 50. It may also be determined by taking readings of the gauge. The movement arm with the person installed is then moved to another, less extreme position, and the weight 114 is again adjusted until the movement arm is balanced for that position. The process may have to be repeated until the center of gravity of the person's body above axis 20 is aligned with the center of gravity of weight 114 and the axis 20. This condition is shown in FIG. 9 where the center of gravity of the person's upper body is shown at 135 and the center of gravity of the weight 114 is shown at 136, and both are alighed with each other and axis 20. Once this condition is reached, the person's weight and mass will be balanced for all of the test or exercise positions providing, of course, that the person remains in the same fixed position relative to the movement arm.

The Test Mode of the Apparatus

Figure 16:
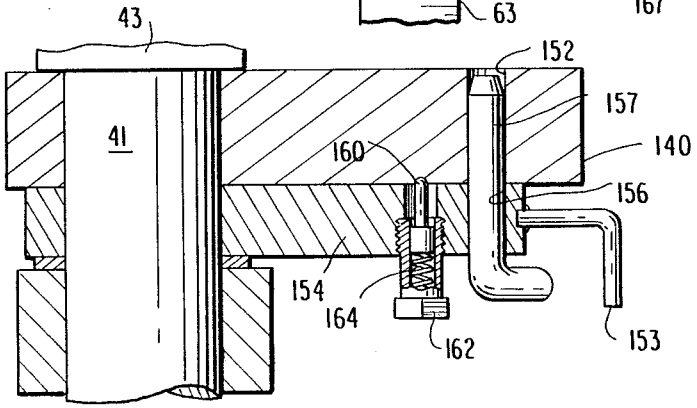
FIG. 16 is a cross-sectional view taken generally along lines 16—16 of FIG. 15.

In one mode, the shown apparatus is employed to the test strength of the lumbar muscles in each of several different angular positions as described above in connection with FIG. 1B. The precise positioning of the movement arm 40 is achieved through apparatus which, in the specific embodiment shown in FIGS. 14, 15, and 16, includes a locking plate 140 fixed to one of the blocks 43 which is fixed to the stationary frame and mounts one of the stub shafts 41 on the left side of the movement arm. As shown in FIG. 15, locking plate 150 is provided with a series of apertures 152 spaced along an arc in a range, for example of thirty-five degrees (35) and with each aperature 152 spaced, for example, seven degrees (7) from each other. A stop lever 154 is provided with an aperture 156 adapted to be placed in registry with any of the apertures 152 of the locking plate 150. Stop lever 154 is mounted for rotation about stub shaft 41 outwardly of the locking plate 140 in order to place into alignment, the aperture 156 of the stop lever and any of the apertures 152 of the locking plate as is desired. A handle 153 may be fixed to stop lever 154 to facilitate adjustment of the stop lever. When the desired aperture alignment is achieved, a locking pin 157 is inserted through the aligned apertures 156 and 152 as best shown in FIG. 16 to fix the stop lever in stationary position. In the preferred embodiment, a detent 160 is slidably mounted in stop lever 154 to be moveable over the surface of the locking plate 140 and into any one of a series of depressions formed in the surface of locking plate 140 as best shown in FIG. 15 to indicate and hold the alignment between the apertures 156 and 152. Once the detent 160 is in position in one of the depressions, the locking pin 157 may be inserted. Detent 160 is slidably received in a sleeve 162 threaded in a passage formed in locking lever 154 as shown in FIG. 16. Detent is releasably biased against the surface of the locking lever by a compression spring 164.

Figure 14:
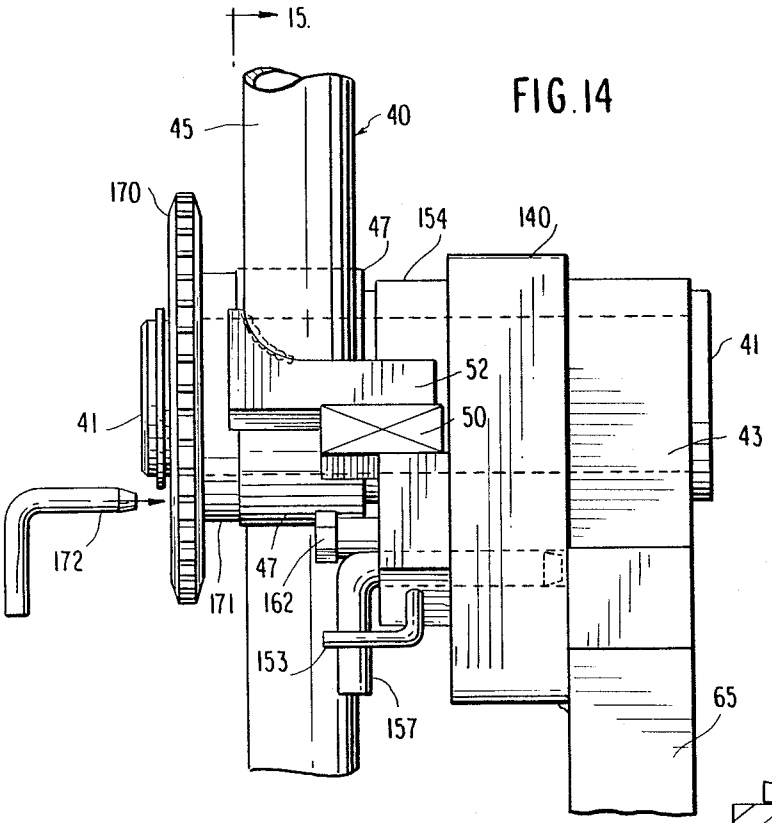
FIG. 14 is an enlarged, fragmental rear view of a left side portion of the apparatus.

The position of the stop lever determines the position of stop 50 which as described above, is preferably a suitable gauge such as a strain gauge. Precise positioning of the movement arm is obtained by stop 52 which may be a lug fixed to one side of the movement arm to be engageable with the stop 52 on the stop lever 154 as shown in FIGS. 14 and 15. After a patient is properly installed and secured in the apparatus as described above, the strength of the patient's lumbar muscles is tested by directing the patient to apply a force through his upper back against the resistance object 34 while the stop 52 on the movement arm 40 is engaged against the strain gauge 50 as shown in FIGS. 14 and 15. The strength of the lumbar muscles will be reflected in the readings taken from the strain gauge 50. For accuracy, the test is repeated for different angular positions achieved by removing locking pin 157, rotating stop lever to the next desired position determined by the detent 162 and then inserting locking pin 157 into apertures 156 and 152 to lock the movement arm in the desired, predetermined position.

The Exercise Mode of the Apparatus

In the exercise mode of the apparatus shown in FIG. 11 and to be described below, it is necessary to space stops 50 and 52 from each other as shown in FIG. 11 to allow the movement arm to pivot to and fro without obstruction over a range of, for example, thirty-five degrees (35). This is achieved by removing locking pin 157 from one of the apertures 152 and moving the stop lever 154 to the position shown in FIG. 11. This position is determined by an aperture 167 formed through locking plate 140 as shown in FIG. 15 to receive the locking pin 157. A depression 168 is formed in the surface of the locking plate for receiving the detent 160 when the stop lever is moved to the exercise position.

To convert the apparatus for exercising the lumbar muscles, it is necessary to connect the movement arm 40 to a resistance weight system generally designated W as shown in FIG. 11; it being understood that in the testing mode of the apparatus, the movement arm 40 is disconnected from the weight system. In the specific embodiment shown and with reference to FIGS. 10 and 14, a sprocket 170 is mounted for rotation on stub shaft 41 on the left side of the movement arm 40 with the hub 71 of the sprocket located against the hub 47 of the movement arm outwardly thereof. Alignable apertures are provided through the hubs 71 and 47 of the sprocket and movement arm to receive a locking pin 172 to unite the sprocket and movement arm for movement together about shaft 41. To release the sprocket from the movement arm when it is desired to disconnect the weight system, for example, when connecting the apparatus into the mode for testing the lumbar muscles, the locking pin 172 is merely removed from the sprocket hub 171.

Referring to FIGS. 10 and 11, sprocket 170 is connected to weight system W by means of a cable or chain 42 having one end trained about and fixed to the periphery of the sprocket and an opposite end fixed to a cam 174. The cam is fixed to a shaft 175 journalled in bearing blocks 176 which are fixed to a stationary support frame 177. Also fixed to shaft 175 is a sprocket 178 having a chain 179 trained about and fixed at one end to the sprocket 178 and at the opposite end connected to weight system W. Support frame 177 is a generally rectangular open tower structure formed of structural steel members as best shown in FIGS. 10 and 11 and which are of sufficient strength to support the resistance weights to be described.

Compound Weight System

Figure 17:
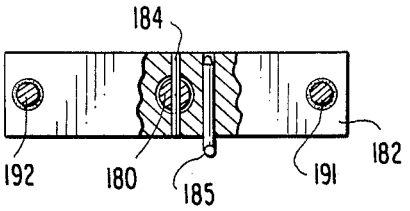
FIG. 17 is a cross-sectional view taken generally along lines 17—17 of FIG. 11.

In the preferred embodiment, the weight system W incorporates a unique compound system of weights in accordance with another feature of the invention. This system, in the specific embodiment shown, includes an elongated vertically extending weight rod 180 connected at its top to the chain 179 and extending to the base 181 of the support frame 177. Fixed at spaced intervals along the rod 180 are a pair of top plates 182 and 183 which have a rectangular shape and receive the weight rod 180 through apertures provided centrally through the plates as illustrated in FIG. 17 which shows top plate 182. Weight rod 18 is fixed to top plate 182 and 183 by pins 184 fixed in transverse apertures aligned in the top plates and weight rod as shown in FIG. 17. In addition, each top plate 182 and 183 has a passage extending transversely thereof for receiving for storage, a weight selector pin 185 which may be removed and used to select the desired weight as will be described. In the preferred embodiment, the combined weight of the top plates 182, and 183, the weight rod 180 and the selector pins 185 is twenty pounds (20 lb.).

Figure 18:
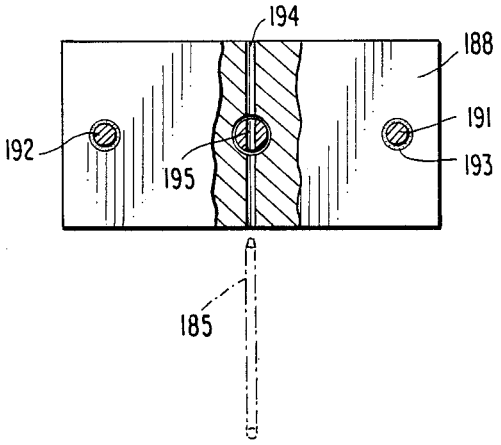
FIG. 18 is a cross-sectional view taken generally along lines 18—18 of FIG. 11 and with a pin shown in dotted lines.

Associated with the top plates 182 and 183, respectively, are an upper and lower stack of weights in the form of rectangular plates or bars. The lower stack is supported on the base 181 of the support frame and includes, in the specific embodiment, thirty-eight plates 188 each weighing precisely twenty pounds (20 lbs.). Plates 188 may be made from any suitable material such as steel. The upper weight stack in the specific embodiment includes twenty plates 189 each made from aluminum and weighing precisely one pound (1 lb.). The upper weight stack is supported on a horizontal deck 190 fixed to and between the vertical members of the support frame 177. To position the weight plates of each stack and to guide them during movement as will be described, a pair of elongated, parallel guide rods 191 and 192 are provided to extend through aligned apertures 193 formed through the weight plates at opposite end portions as best shown in FIGS. 11 and 18. Guide rods 191 and 192 are fixed to base 181 and deck 190, however, the weight plates are freely movable along the rods; it being understood that the circular apertures 193 in the weight plates are sufficiently greater than the diameter of the rods 191 and 192 to allow such free movement. As shown in FIG. 18 with respect to the weight plates 188 of the lower stack, each of the weight plates has a passage 194 extending transversely therethrough in alignment with a passage 195 extending through the weight rod 180; it being understood that the weight rod has a series of apertures 195 spaced throughout along its length for registry with apertures 194 of the weight plates.

To select a weight to be lifted by the exerciser, the pins 185 may be inserted in the appropriate weight plates 188 and 189 of the lower and upper stacks to thus, in effect, connect all the weight plates above and including the weight plates bearing the pins 185, to be lifted during an exercise. The maximum stroke of the lifted weight plates is determined by engagement of the top plates 182 and 183 in each stack with the associated stationary stops 190 and 190*a* and hence, equal to the distance between the top plates and the associated stops; this distance being only three inches (3″) in the preferred embodiment and, of course, the same for both stacks. With this compound stack, it is possible to vary the weight to be lifted in one pound increments from a minimum weight of twenty pounds (20 lbs.) when the pins 185 are left in their storage apertures of the top plates 182 and 183 to a maximum weight of eight hundred pounds (800 lbs.) when the pins 185 are inserted in the lowermost weight plates of each stack. It will be apparent that instead of the weight combinations shown and described above, weight plates of different magnitudes and numbers may be used in the upper and lower stacks.

Summary of Operation

To summarize use of the apparatus for exercise, the exerciser is secured on the seat 22 in the above-described manner to anchor his pelvis. His upper body is then secured to the resistance object 34 by means of straps 34 and 36 and with his arms in fixed position as achieved by grasping the handles 53 as shown in FIG. 9. While the weight system W is disconnected from the movement arm 40 by removal of locking pin 172 from sprocket 170, the movement arm is balanced to place the center of gravity 135 of the exerciser in alignment with the center of gravity 136 of the adjustable counterweight 114 and the axis 20 of rotation of the movement arm 40. The proper amount of weight is thus selected by inserting the pins 185 into the weight plates 188 and 189 of the compound weight system. The locking pin 172 is then inserted through the hubs 171 and 47 of the sprocket 170 and movement arm 40 to lock the sprocket 170 to the movement arm 40. The exercise may then be commenced by the exerciser applying a force to the resistance object 34 to pivot the movement arm to successively lift and lower the weights as force is applied and released relative to the movement arm. Note that maximum stroke of the weights is relatively small, thus avoiding harmful impact loads as the weights descend when force on the movement arm is released. Having isolated the lumbar muscles from the gluteus and hamstring muscles, the exerciser is able to efficiently exercise his lumbar muscles by lifting and lowering a preselected weight in the manner described above.

When it is desired to test the strength of the lumbar muscles, the locking pin 157 is removed from aperture 167 of the stop lever 154, and the locking lever 154 is moved counterclockwise as viewed in FIGS. 11 and 15 to register the aperture 156 of the locking lever 154 with the lowermost aperture 152 of the locking plate 140. Locking pin 157 is then inserted through the apertures 156 and 152 to fix the strain gauge stop 50 in the desired position. The locking pin 172 is then removed from the sprocket hub 171 to disconnect the weight system W from the movement arm 40. The movement arm is then eased downwardly to engage the movement arm stop 52 on the strain gauge 50. The exerciser then applies a force to the resistance object 34 which is transmitted to the strain gauge to give a reading of the strength of the lumbar muscles. The process is then repeated at seven degree (7°) intervals by repositioning the locking lever 154 and reinserting the locking pin 157 in the appropriate aperture 152 of the locking plate 140. In this manner, the strength of the lumbar muscles may be tested five times at seven degree (7°) intervals of the movement arm.

Although the apparatus shown and described above is particularly adapted for exercising or testing the lumbar muscles, other apparatus not shown in detail, may be employed within the teachings of the present invention, to exercise or test the abdominal muscles and rotary torso muscles in accordance with the methods described above in conjunction with FIGS. 3 and 4. In each method and apparatus, the pelvis is secured against movement by the same method and apparatus shown and described above. However, the upper part of the apparatus including the movement arm will vary depending upon whether lumbar, abdominal or rotary torso muscles are being exercised or tested. For example, as shown in FIG. 3, apparatus for exercising or testing the abdominal muscles, will have the movement arm 40*a* located in front of the exerciser who will apply a forwardly directed force to the movement arm through the resistance object 34*a*. In the method of FIG. 4 for exercising or testing the rotary torso muscles, the movement arm (not shown) will be mounted for movement about a vertical axis by a force exerted by the upper back as it rotates about the spine as illustrated by the arrows in FIG. 4.

Although several methods and apparatus incorporating the invention have been specifically shown and described for purposes of disclosing examples of the invention, various other modifications and adaptations of the invention will become apparent to those skilled in the pertinent art but without departing from the scope of the invention which appears in the appended claims.

What is claimed is:

1. Apparatus for exercising the muscles of the lower trunk of a human body, the apparatus comprising in combination, a seat for receiving a person in sitting position, means associated with the seat for restraining against movement the pelvis of a person seated on said seat, a movement arm extending above the seat and being mounted for pivotal movement relative to the seat about a generally horizontal axis, said movement arm having an upper portion engageable by an upper trunk portion of the body for applying with the muscles of said lower trunk a force to the movement arm to pivot the movement arm about said axis, and a freely movable resistance weight connected to the movement arm to be lifted when a force is applied to the movement arm by said muscles to pivot the movement arm in one direction and to be lowered when the force is released to pivot the movement arm in a direction opposite to said one direction, the movement of said weight being controlled solely by the application and release of said force relative to said movement arm and means for fixing the positions of the arms and head of the body relative to the movement arm during movement of said movement arm.

2. Apparatus defined in claim 1 including a counterweight below said axis and connected to the movement arm to impose a moment about said axis to substantially counterbalance the upper trunk of the human body about said axis, and means for adjusting the position of said counterweight relative to said axis for changing the moment of said counterweight about said axis to counterbalance the upper trunk of a particular human body.

3. Apparatus defined in claim 1 further including counterweight means below said axis and connected to said movement arm for substantially counterbalancing the movement arm as well as the upper trunk of the body about said axis.

4. Apparatus defined in claim 3 wherein said counterweight means includes an adjustable counterweight for counterbalancing the upper trunk of the human body about said axis.

5. Apparatus defined in claim 1 further including a compound weight system including first and second groups of weights with weights of one group being independent of and different in magnitude than the weights of the other group, and means for selectively interconnecting a number of weights from both groups to constitute said resistance weight.

6. Apparatus defined in claim 2 further including a compound weight system including first and second groups of weights with weights of one group being independent of and different in magnitude than the weights of the other group, and means for selectively interconnecting a number of weights from both groups to constitute said resistance weight.

7. Apparatus defined in claim 1 wherein said movement arm is positioned to be engaged by the upper back of the body to move the movement arm by forces applied by the lumbar muscles of the body.

8. Apparatus defined in claim 1 wherein said movement arm is positioned to be engaged by the upper front of the trunk of the body to move the movement arm by forces applied by the abdominal muscles of the body.

9. Apparatus for exercising the muscles of the lower trunk of a human body, the apparatus comprising in combination, a seat for receiving a person in sitting position, means associated with the seat for restraining against movement the pelvis of a person seated on said seat, a movement arm extending above the seat and being mounted for pivotal movement relative to the seat about a generally horizontal axis, said movement arm having an upper portion engageable by an upper trunk portion of the body for applying with the muscles of the lower trunk a force to the movement arm to pivot the movement arm about said axis, a freely movable resistance weight connected to the movement arm to be lifted when a force is applied to the movement arm by said muscles to pivot the movement arm in one direction and to be lowered when the force is released to pivot the movement arm in a direction opposite to said one direction, the movement of said weight being controlled solely by the application and release of said force relative to said movement arm, a counterweight below said axis and connected to the movement arm to substantially counterbalance the upper trunk of the body about said axis, means for fixing the positions of the arms and head of the body relative to the movement arm during movement of said movement arm, and a compound weight system including first and second independent groups of weights with weights of one group being different in magnitude than weights of the other group, and means for selectively interconnecting a number of weights from both groups to constitute said resistance weight.

10. Apparatus for exercising the muscles of the lower trunk of a human body, the apparatus comprising in combination, a seat for receiving a person in sitting position, means associated with the seat for restraining against movement the pelvis of a person seated on said seat, a movement arm extending above the seat and being mounted for pivotal movement relative to the seat about a generally horizontal axis, said movement arm having an upper portion engageable by an upper trunk portion of the body for applying with the muscles of said lower trunk a force to the movement arm to pivot the movement arm about said axis, resistance means connected to the movement arm to create resistance to movement, counterweight means below said axis and connected to said movement arm for counterbalancing the movement arm as well as the trunk of the body about said axis, said counterweight means including a first counterweight imposing a moment about said axis and means for adjusting the position of the counterweight relative to said axis for changing the moment imposed by the counterweight to counterbalance a particular body being exercised, said counterweight means including a second counterweight located below said axis and connected to the movement arm for counterbalancing the movement arm abut said axis, and means for fixing the positions of the arms and head of the body relative to the movement arm during movement of said movement arm.

11. Apparatus for exercising the muscles of the lower trunk of a human body, the apparatus comprising in combination, a seat for receiving a person in sitting position, means associated with the seat for restraining against movement the pelvis of a person seated on said seat, a movement arm extending above the seat and being mounted for pivotal movement relative to the seat about a generally horizontal axis, said movement arm having an upper portion engageable by an upper trunk portion of the body for applying with the muscles of said lower trunk a force to the movement arm to pivot the movement arm about said axis, resistance means connected to the movement arm to create resistance to movement, a first counterweight connected to the movement arm and imposing a moment about said axis and means for adjusting the position of the counterweight relative to said axis for changing the moment imposed by the counterweight to counterbalance the upper trunk of a particular body being exercised, means for fixing the positions of the arms and head of the body relative to the movement arm during movement of said movement arm, and a compound weight system including first and second independent groups of weights with weights of one group being different in magnitude than weights of the other group, and means for selectively interconnecting a number of weights from both groups to constitute said resistance means.

12. Apparatus for exercising the muscles of the lower trunk of a human body, the apparatus comprising in combination, a seat for receiving a person in sitting position, means associated with the seat for restraining against movement the pelvis of a person seated on said seat, a movement arm extending about the seat and being mounted for pivotal movement relative to the seat about a generally horizontal axis, said movement arm having an upper portion engageable by an upper trunk portion of the body for applying with the muscles of said lower trunk a force to the movement arm to pivot the movement arm about said axis, and a resistance means connected to the movement arm to create resistance to movement, means for fixing the position of the arms and head of the body relative to the movement arm during movement of the movement arm and a compound weight system including first and second independent groups of weights with weights of one group being different in magnitude than weights of the other group, and means for selectively interconnecting a number of weights from both groups to constitute said resistance means.

13. Apparatus defined in claim 12 wherein said movement arm is engaged by the back of the body to move the movement arm by forces applied by the lumbar muscles of the body.

14. Apparatus for exercising the muscles of the lower trunk of a human body, the apparatus comprising in combination, a seat for receiving a person in sitting position, means associated with the seat for restraining against movement the pelvis of a person seated on said seat, a movement arm extending above the seat and being mounted for pivotal movement relative to the seat about a generally horizontal axis, said movement arm having a portion engageable by an upper trunk portion of the body for applying with the muscles of said lower trunk a force to the movement arm to pivot the movement arm about said axis, and resistance means connected to the movement arm to create resistance to movement of the movement arm, and means on the movement arm for fixing the positions of the arms and head of the body relative to the movement arm during movement of the movement arm.

* * * * *